US006050034A

United States Patent [19]

Krinner

[11] Patent Number: 6,050,034

[45] Date of Patent: Apr. 18, 2000

[54] ANCHORING DEVICE FOR A POLE- OR POST-LIKE OBJECT

[75] Inventor: Klaus Krinner, Blumenthal 23, 94342 Strasskirchen, Germany

[73] Assignee: Klaus Krinner, Strasskirchen, Germany

[21] Appl. No.: 09/011,208

[22] PCT Filed: Jul. 18, 1996

[86] PCT No.: PCT/EP96/03179

§ 371 Date: May 20, 1998

§ 102(e) Date: May 20, 1998

[87] PCT Pub. No.: WO97/05350

PCT Pub. Date: Feb. 13, 1997

[30] Foreign Application Priority Data

Jul. 28, 1995 [DE] Germany ..... 295 12 237 U

[51] Int. Cl.[7] ..... F02C 31/00

[52] U.S. Cl. ..... 52/155; 52/157; 52/165; 52/169.13; 52/298; 248/165; 248/514; 248/515; 248/550; 248/523; 248/530; 403/DIG. 8

[58] Field of Search ..... 52/155, 156, 157, 52/165, 169.13, 298, 153, 154, 116, 126.1, 126.2; 248/530, 156, 514, 523, 524, 521, 515, 516, 520; 403/367, DIG. 8; 285/148.23, 148.27

[56] References Cited

U.S. PATENT DOCUMENTS

| | | | |
|---|---|---|---|
| 369,371 | 9/1887 | Tourgée | 52/156 |
| 533,906 | 2/1895 | Leuty | 52/165 |
| 1,304,979 | 5/1919 | Hirshstein | 285/148.23 |
| 1,856,000 | 4/1932 | Smith | 248/523 X |
| 2,216,208 | 10/1940 | Michon | 403/DIG. 8 X |
| 3,769,768 | 11/1973 | Bertrand | 52/154 |
| 4,225,264 | 9/1980 | Coone | 403/DIG. 8 X |
| 4,261,138 | 4/1981 | St. George Syms | 248/523 X |
| 4,279,107 | 7/1981 | Bollman | 52/169.13 |
| 4,420,272 | 12/1983 | Ingalls et al. | 403/4 |
| 4,662,139 | 5/1987 | Bollman | 52/169.13 X |
| 4,972,642 | 11/1990 | Strobl, Jr. | 52/165 X |
| 5,404,682 | 4/1995 | West | 52/155 X |
| 5,535,978 | 7/1996 | Rodriguez et al. | 248/523 X |

FOREIGN PATENT DOCUMENTS

| | | | |
|---|---|---|---|
| 456603 | 9/1913 | France | 52/157 |
| 1383253 | 11/1964 | France | 52/157 |
| 1279899 | 10/1968 | Germany | 248/515 |
| 4400159 | 7/1975 | Germany . | |
| 3014889 | 9/1984 | Germany . | |

*Primary Examiner*—Laura A. Callo
*Attorney, Agent, or Firm*—Jones, Day, Reavis & Pogue

[57] ABSTRACT

An anchoring apparatus for securing a pole into ground, which includes a tubular section being retained in the ground for supporting the pole. A support element is disposed on the open end of the tubular member, for supporting the pole proximate to the open end. The support element includes an annular outer member, which is rotatably disposed on the tubular section, and includes a support aperture eccentrically offset with respect to the center of the outer member. An annular inner member is rotatably disposed within the support aperture, and includes a receiving aperture eccentrically offset with respect to the center of the inner member, for supporting the pole. The outer member and inner member are respectively rotatable to vary the positions of the support aperture and the receiving aperture, so as to selectively tilt the poles longitudinal axis to a desired position with respect to the direction of the longitudinal axis of the tubular section.

9 Claims, 6 Drawing Sheets

ANCHORING DEVICE FOR A POLE- OR POST-LIKE OBJECT

The invention relates to an anchoring device for a pole- or post-like object.

When erecting poles, stakes or posts, for instance when putting up a fence, erecting a sign-post or the like there is always arising the difficulty of maintaining the stake or post in the exactly vertical position, if possible. The vertical alignment can be effected, for instance, by checking the vertical alignment by means of a spirit level or a vertical line and possibly correcting it when the pole-, stake- or post-like object is fixed or anchored in the ground, for instance, by driving it into the ground or ease imbedding it in concrete. This is difficult and time-consuming, because, for instance, when driving a stake or post into the ground the driving operation has to be repeatedly interrupted in order to check and possibly correct the alignment. When imbedding a pole or post in concrete the exactly vertical erection of the same can be subsequently corrected without difficulty when the concrete has not yet set, then, however, means have to be applied to maintain this exactly vertical position until the concrete has set so that this vertical alignment cannot change any more by itself; i.e. the pole or post has to be laterally supported or braced, for example.

Apart from driving or digging in or else imbedding a pole or post in concrete, it is known to use fastening devices which can be anchored in the ground and which then support the post- or pole-like object at their upper free end. The fastening device adapted to be anchored in the ground comprises, for instance, a worm or screw which is turned into the ground like a corkscrew and then the post or pole is screwed to this fastening device or inserted in the same. In DE-GM 93 13 258 an example hereof is described. It is further known to design the post- or pole-like object and the fastening device adapted to be anchored in the ground like a corkscrew in one piece so that the object includes the fastening device at one of its free ends which is then screwed into the ground and anchored therein.

With these two methods or these possibilities of erecting a pole or post, too, substantially the same problems regarding the vertical arrangement of the post or pole are arising as when driving the same in or imbedding it in concrete. Instead of the driving operation, in this case the turning of the fastening device into the ground must be repeatedly interrupted to ensure the later vertical alignment of the post or pole by appropriate measuring and correcting operations, if necessary.

Therefore, in the past already adjusting mechanisms have been disposed on the fastening devices to allow an adjustment of the position of the object with respect to the fastening device. For instance, DE-GM 88 09 142 shows the possibility of the vertical adjustment of a post with respect to a ground plate by means of a ball-and-socket joint. U.S. Pat. No. 4,199,908 enables the alignment of a post or pole in vertical direction due to oblong recesses in a support member.

DE-GM 88 09 142 has the essential constructional drawback, however, that when tightening the ball socket encasing the ball head hardened projections formed in the socket are intended to dig into the material of the ball head to ensure the position of the pole in addition by a positive locking. In practice this means that with a changing mounting position of the support, which requires a different position of the ball head with respect to the support, due to the ball head possibly deformed by the projections the same may no longer be safely held in the new position by the ball socket and has to be exchanged.

The adjusting device according to U.S. Pat. No. 4,199,908 permits only an adjustment in one plane. Moreover, it has constructional drawbacks in so far as for ensuring a correct functioning the bottom arm has to be anchored in such a depth in the concrete foundation that the bore in that case is aligned with the oblong hole of the support member, because otherwise the screw can no longer pass through these two bores in which the adjusting operation is effected in one direction.

From the generic DE-GM 93 13 260 of the same applicant different embodiments of anchoring devices for pole- or post-like objects in the ground have become known which comprise a threaded section which can be drilled into the ground and removed again in the same way and a tubular section designed to hold the object, a device designed to maintain the object in the upright position with respect to the tubular section being located in the tubular section so that the object can be maintained in the vertical position even if the threaded section is not drilled into the ground in an exactly vertical manner Although all anchoring devices described in DE-GM 93 13 260 have substantially proved successful in practice, they still have the small defect that the once selected position of the pole- or post-like object can only be varied relative to the anchoring device by major manipulation which is time-consuming. So several draw spindles have to be loosened, for instance, and/or other thicker or thinner washer profiles have to be used to vary the relative position of the object to the anchoring device. If it is necessary, for example in the case of a fence which was urged into an inclined position by external forces, to bring the individual posts into the vertical position again, with the anchoring devices according to DE-GM 93 13 260 possibly dozens of individual anchoring devices have to be readjusted, which is time-consuming and unsatisfactory in practice.

Compared to this, it is the object of the present invention to design an anchoring device according to the preamble of claim 1 so that a pole- or post-like object can be quickly and exactly brought into the vertical position by the same, wherein this vertical position or alignment can be just as quickly readjusted, if necessary,.

This object is achieved, according to the invention, by the features described in claim 1.

Accordingly, a device for anchoring a pole- or post-like object in the ground is provided according to the invention, comprising a threaded section which can be drilled into the ground and removed again in the same way and a tubular section designed to hold the object, a device designed to maintain the object in the upright position with respect to the tubular section being located in the tubular section, the anchoring device being characterized in that the device which maintains the object in the upright position has a support element which is located in the tubular section and which has an aperture enabling it to fit around the object, the support element being movable with respect to the tubular section to enable the direction of the longitudinal axis of the object to be adjusted with respect to the direction of the longitudinal axis of the tubular section and to remain locked in place in any position selected, wherein the support element consists of two pieces comprising an annular outer member to be disposed on the tubular section and defining a support aperture and an annular inner member which is rotatably disposed in the support aperture of the outer member and defines the receiving aperture for the object, wherein the center of the receiving aperture is eccentrically offset with respect to the center of the inner member and the center of the support aperture is eccentrically offset with respect to the center of the outer member.

The anchoring device according to the invention on the one hand permits to quickly and exactly maintain the pole- or post-like object in the upright position in the tubular section so that the object is located exactly vertically, on the other hand, however, the movability of the support element with respect to the tubular section in addition permits to readjust the object with respect to the tubular section, if necessary, so that in case the anchoring device is displaced in the ground, for instance by forces acting from outside, wherein such a displacement entails a tilting of the pole- or post-like object, this object can be readjusted with respect to the anchoring device in order to adopt its original vertical position again.

Due to the fact that the object remains locked in place with respect to the tubular section in any adjusted position, additional fastening or fixing means are not necessary so that such fastening or fixing means need not be loosened for readjusting operations.

Advantageous further developments of the invention are the subject-matter of the subclaims.

Preferably the aperture in the support element is eccentrically adjustable in one direction wish respect to the longitudinal axis of the tubular section. If, according to another preferred embodiment, the support element is furthermore rotatable relative to the tubular section, with a simple constructional design the possibility is provided to adjust the direction of the longitudinal axis of the pole- or post-like object with respect to the direction of the longitudinal axis of the tubular section to all sides, the longitudinal axis of the pole- or post-like object being located on the outer surface area of a circular cone the center line of which is the longitudinal axis of the tubular section.

The outer member and the inner member preferably have attachment points for a tool by which the outer member can be twisted with respect to the tubular section and the inner member can be twisted with respect to the outer member.

Both the outer member and the inner member preferably have an axially and radially passing slit in the area of their smallest wall thicknesses. This enables to manufacture the outer member with respect to the tubular section and the inner member with respect to the support aperture of the outer member to be slightly interfering so that the outer member has a slight press fit in the tubular section and also the inner member has a slight press fit in the support aperture of the outer member, and in this way the outer member and the inner member are locked in place with respect to each other and to the tubular section, resp., solely by friction without any additional means. In this way, possible tolerance variations during manufacture are likewise almost completely compensated. Furthermore it is particularly preferred to manufacture the receiving aperture for clamping the object so as to have a dimension smaller than specified with respect to the diameter of the object. Hereby and by the slit in the inner member the inner member is somewhat widened or expanded when it is pushed onto the object so that it is located on the object by press-fit and cannot get out of place or get lost. Moreover, when forcing the somewhat expanded inner member into the support aperture of the outer member, the inner member is pinched so that the same gets into close contact with the object and safely clamps the same and the inner member is also safely held in the support aperture of the outer member.

The inner member as well as the support aperture and the receiving aperture preferably have a wall extending obliquely with respect to the respective longitudinal axis. The fit of the outer member in the tubular section as well as the fit of the inner member in the support aperture of the outer member is hereby ensured solely by the influence of gravity. Furthermore the object is simply but still reliably pinched or clamped in the receiving aperture of the outer member, when the inner member and the outer member are moving relative to each other along the conical surfaces.

If the inner member has a circumferential rail-like projection at the inner circumferential wall of the receiving aperture, the pole- or post-like object can be better supported, because it can be adjacent to a defined line or edge.

In another preferred embodiment the longitudinal axis of the inner member may be tiltable with respect to that of the outer member by turning the inner member relative to the outer member. Hereby also larger adjusting angles can be realized.

The tubular section is preferably tapered conically downward at a longitudinal section opposite to the support member at least in the interal cross-section. This conically tapered longitudinal section constitutes the lower support point for the post- or pole-like object, and because this longitudinal section is conically tapered, it fits automatically with different diameters of the object without particular fastening means being necessary.

Further details, aspects and advantages of the present invention are resulting from the following description of embodiments by way of the drawings, in which FIG. 1A is a top view of an annular inner member according to an embodiment of the present invention;

Figure 1A:
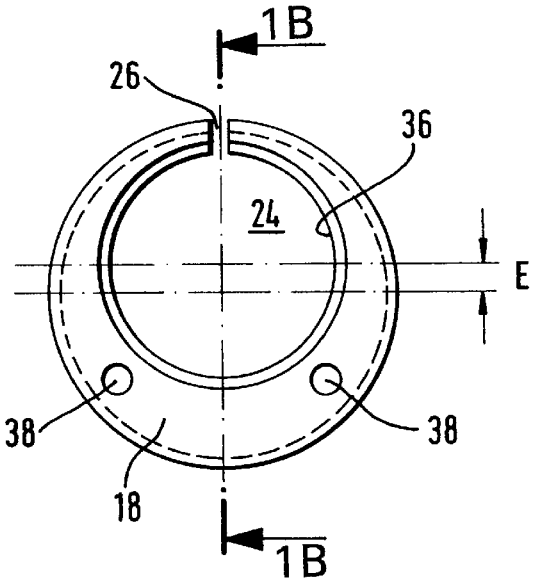
FIG. 1B is a section across the inner member of FIG. 1A along the line 1B—1B.

By way of the FIGS. 1A to 4 and 7 in the following a first embodiment of the present invention will be explained in more detail.

An anchoring device for a post- or pole-like object 4 altogether denoted with 2 substantially includes a tubular section 6 designed to hold the object 4 as well as a device 8 for maintaining the object in the upright position with respect to the tubular section 6. At the lower end of the tubular section 6 in FIG. 7 a threaded section not visible is formed by which the anchoring device 2 can be drilled into the ground and removed again in the same way. As regards further details of the threaded section, it is referred to DE-GM 93 13 258 of the same applicant.

Figure 7:
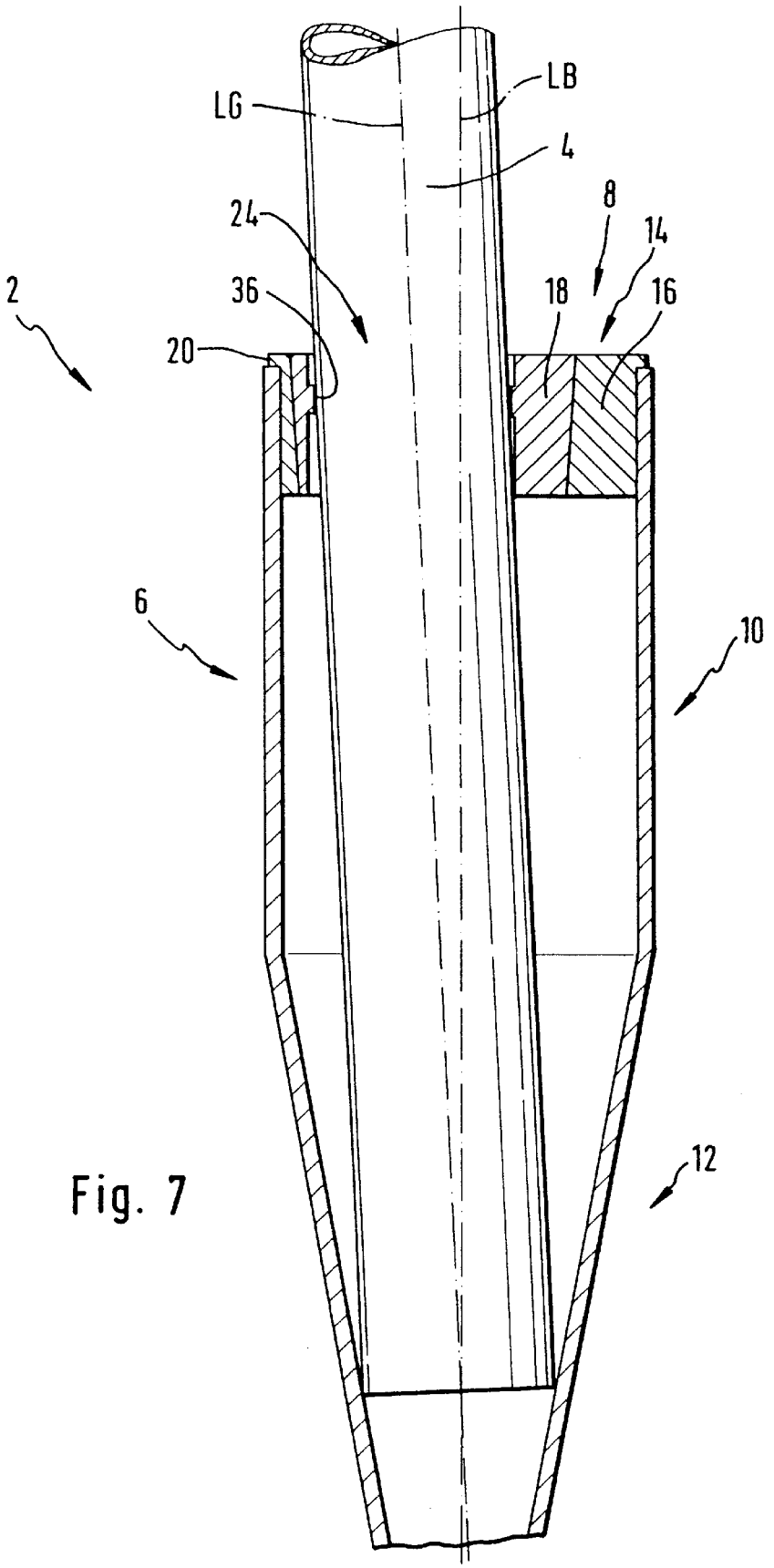
FIG. 7 is a longitudinal section across an embodiment of an anchoring device according to the invention utilizing the outer member and the inner member according to the FIGS. 1A to 4.

The tubular section 6 comprises an upper portion 10 having a substantially constant cylindrical cross-section as well as a portion 12 adjacent hereto downward in FIG. 7 which is conically tapered in the direction of the threaded section that is not represented. At the upper open end of the tubular section and its portion 10, resp., the device 8 designed to maintain the object 4 in the upright position is arranged.

According to the FIGS. 1A to 4 this device 8 is formed by a support element 14 designed in two pieces having an annular outer member 16 to be arranged at the tubular section 6 (FIGS. 2A and 2B) and an annular inner member 18 (FIG. 1A and 1B), wherein the outer member 16 according to FIG. 7 can be inserted into the open end of the tubular section 6 from the top and is supported at the upper edge of the tubular section 6 by an annular circumferential flange or a shoulder 20. The outer member 16 defines a support aperture 22 into which the inner member 18 can be rotatably inserted, as one can take from FIGS. 3 to 5. The inner member in turn defines a receiving aperture 24 which, according to FIG. 7, serves for receiving the object 4.

As the FIGS. 1A, 2A, 3 and 4 illustrate, the outer member 16 and the inner member 18 do not have a closed annularly circumferential design, but each of them has an axially and radially continuous slit 26 arid 28. Furthermore, according to FIGS. 1A and 2A, the centers of the support aperture 22 and the receiving aperture 24 are not aligned with the centers of the outer peripheries of the outer member 16 and the inner member 18 but are displaced by a certain amount of eccentricity E with respect hereto. The outer member 16 and the inner member 18 are thus sickle- or moon-shaped in a top view according to FIGS. 2A and 1A, the slits 26 and 28 being provided in the area of the smallest wall thicknesses.

Figure 1B:
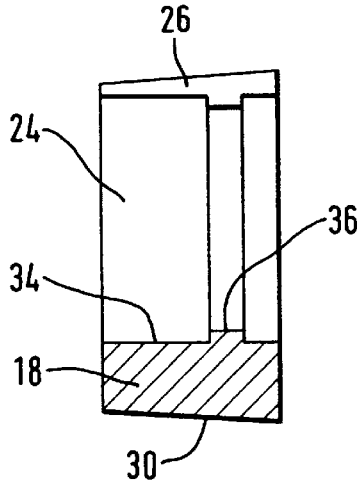
Figure 2A:
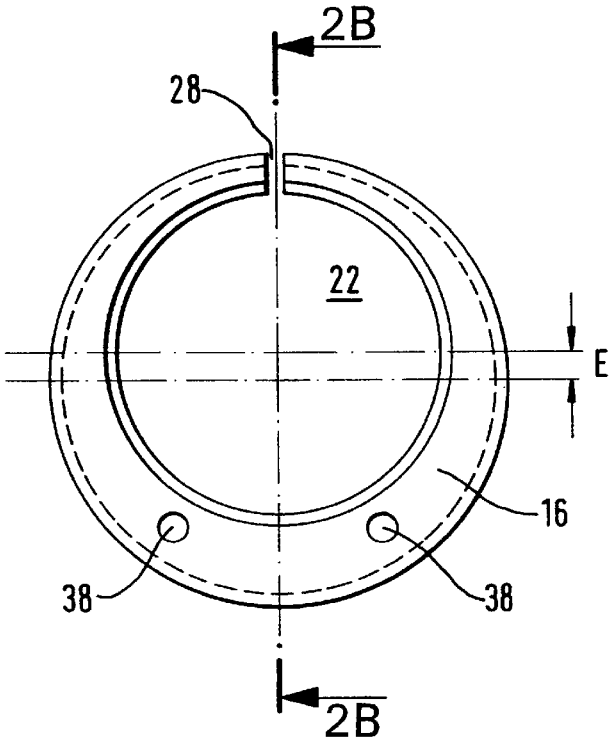
FIG. 2A is a top view of an annular outer member according to an embodiment of the present invention.
Figure 2B:
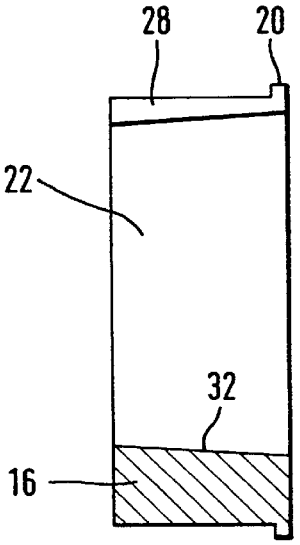
FIG. 2B is a section across the outer member of FIG. 2A along he line 2B—2B.

The outer diameter of the inner member 18 is equal to, but may also be somewhat larger than the inner diameter of the support aperture 22 and the outer diameter of the outer member 16 is likewise equal to or possibly somewhat larger than the inner diameter of the upper area 10 of the tubular section 6. Hereby and by the design of the slits 26 and 28 the outer member 16 in the area 10 and the inner member 18 of the support aperture 22 are kept under pressure and to be slightly positive-locking so that a rotation of the outer member 16 with respect to the tubular section 6 and a rotation of the inner member 18 with respect to the outer member 16 is respectively tight. In addition, the inner member 18 according to FIG. 1B is slightly conical at its outer surface 30 and the outer member 16 is slightly conical at an inner surface 32 of the support aperture 22 so that the inner member 18 is safely held in the support aperture 22 and cannot fall downward into the interior of the tubular section 6 in the position according to FIG. 7.

As already explained before, the diameter ratios of the support aperture 22 and the inner member 18 are not absolutely critical. This is intensified by the conical design of the inner member 18 at its outer surface 30 and of the outer member 16 at its inner surface 32 of the support aperture 22. Variations in tolerance can be compensated hereby by inserting the inner member 18 more or less deeply into the support aperture 22 without the safe fit of the inner member 18 in the support aperture 22 being impaired. Due to the slits 26 and 28 and especially by the slit 26 in the inner member 18, the solution particularly preferred within the scope of the invention is resulting that the receiving aperture 24 for clamping the object 4 is manufactured to have a dimension smaller than specified compared to the diameter of the object 4. Hereby and by the slit 26 provided in the inner member 18 the inner member 18 is somewhat widened or expanded, when it is pushed onto the object so that it is located on the object 4 by press-fit and cannot get out of place or lost. Furthermore, when the somewhat expanded inner member 18 is pressed sufficiently deeply into the support aperture 22 of the outer member 16, the inner member 18 is pinched or clamped so that it is in close contact with the circumference of the object 4 and/or safely clamps the same and the inner member 18 is also safely held in the support aperture 22 of the outer member 16

A circumferential rail-like projection 36 is formed at an inner surface 34 of the receiving aperture 24.

The outer member 16 and the inner member 18 have attachment points 38 in the form of through, or blind bores at their upper side serving as attachment points for a tool by which the outer member 16 can be twisted with respect to the upper cylindrical portion 14 of tubular section 6 and the inner member 18 can be twisted with respect to the outer member 16. One possibility of designing the attachment points 38 and one possibility of a suitable tool is to use a known tool serving for mounting and dismounting the discs of a parting-off grinder.

As already mentioned before, due to the dimensioning of the inner member and the outer member the rotation of the outer member 16 with respect to the tubular section 6 and the rotation of the inner member 18 with respect to the outer member 16 is sluggish, when the inner member 18 is pushed or forced sufficiently deeply into the support. aperture 22 of the outer member 16 enabling it at the same time to circumferentially clamp the object 4, because by the receiving aperture 24 preferably manufactured to have a dimension smaller than specified compared to the diameter of the object 4 force components which are acting radially outwardly are developed which pinch the outer member 16 with respect to the tubular section 6, the inner member 18 with respect to the outer member 16 and the object with respect to the inner member 18. Under certain circumstances it may be desirable to impair this twisting possibility even more or completely block it. To this effect, possibly a clamping device may be provided consisting, for instance, of a bore which passes through the wall of the tubular section and ends at the outer periphery of the outer member. The bore is provided with a female thread so that a hexagon socket screw or grub screw can be screwed into the bore. By tightening the screw the outer member thus can be tightly twisted with respect to the tubular section or the well running of the rotation between the outer member and the tubular section can be adjusted at will. Such clamping devices working with locking screws are generally known; therefore a representation in the drawing is renounced. It is also stated that usually such an additional clamping device is not or only in extreme cases necessary, because the cuter member 16 is circumferentially twisted with respect to the tubular section 6, the inner member 18 is circumferentially twisted with respect to the outer member 16 and the object 4 is circumferentially twisted with respect to the inner member by sufficient radially acting forces due to the conical faces 30 and 32 and the receiving aperture 24 preferably manufactured to have a dimension smaller than specified with respect to the object 4.

Figure 3:
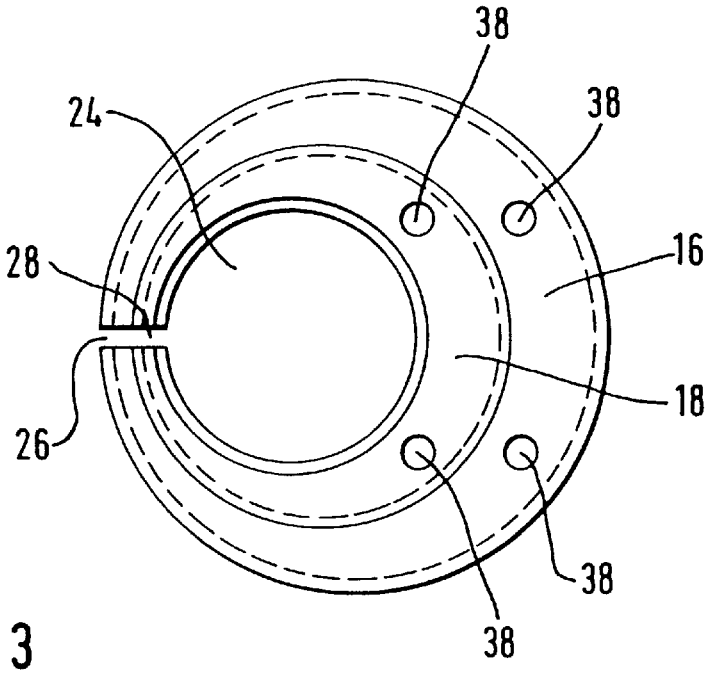
FIG. 3 is a top view of the outer member and the inner member in the assembled state, wherein the aperture formed in the inner member is represented in a maximum eccentricity position.
Figure 4:
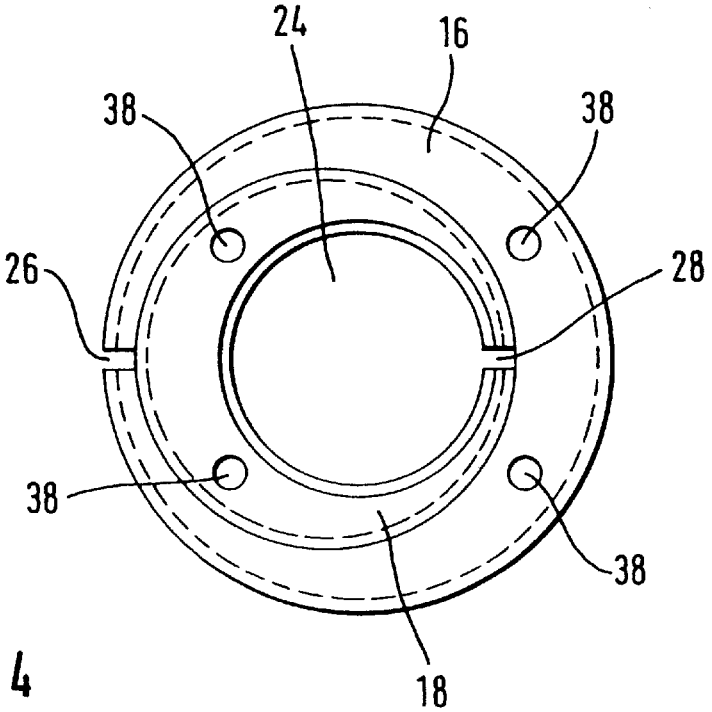
FIG. 4 is a representation corresponding to FIG. 3, the receiving aperture of the inner member being arranged substantially centrally, however.

As it is best resulting from the FIGS. 3 and 4, depending on the relative position of the inner member 18 with respect to the outer member 16 a different position of the receiving aperture 24 is provided, because, due to the eccentricity E of the support aperture 22 and the receiving aperture 24, the receiving aperture 24 is displaced more or less in the direction of the outer circumference of the support element 14 when the inner member 18 is twisted toward the outer member 16 so that the longitudinal axis LG of the object 4 can be displaced from the longitudinal axis LB of the anchoring device 2 and the tubular section 6, resp., by a predetermined amount, as one can best take from FIG. 7. The object 4, which is freely supported with its lower end in the conical portion 12, can hereby be tilted by appropriately twisting the inner member 18 with respect to the outer member 16 and possibly the outer member 16 with respect to the tubular section 6 in each desired direction by an amount determined by the eccentricity E of the inner member 18 and the outer member 16 so that possible oblique positions of the tubular section 6 can be compensated again and thus the object 4 is maintained in the exactly vertical or upright position. The object 4 is supported on the circumferential projection 36 in the receiving aperture 24, as visible from FIG. 7, so that the object is safely held, on the one hand, in the receiving aperture 24 and, on the other hand, at its lower end in the conical portion 12 and is held so that it does not tilt or shake.

When adjusting the direction and the amount of eccentricity, the outer member 16 predetermines the direction of eccentricity, i.e. the direction into which the object to be clamped has to be tilted so as to compensate an oblique or inclined position of the anchoring device drilled into the ground and the inner member 18 predetermines the amount of eccentricity, i.e. the degree of tilting.

As the twisting of the inner member 18 with respect to the outer member 16 and possibly of the outer member 16 with respect to the tubular section 6 is tight, because the outer member 16 preferably manufactured of synthetic material is pressed into the tubular section while the gap 28 first somewhat widened or expanded by the object 4 is compressed again and the inner member 18 likewise preferably made of synthetic material—possibly while compressing the gap 26—is pressed into the support aperture 22, the relative position adjusted by means of the attachment points 38 between the inner member 18 and the outer member 16 and between the outer member 16 and the tubular section 6 is usually maintained and thus also the position of the object 4. In the case of major loads to be expected and acting upon the object 4, for instance permanent vibrations by passing vehicles, strong wind forces or the like, the above-mentioned clamping means may further be provided by which the relative positions of at least the outer member 16 and the tubular section 6 with respect to each other can be partly or entirely blocked. The holding forces of the inner member 18 with respect to the outer member 16 and the clamping of the object 4 in the aperture 24 can be increased as required in that the inner member 18 is pressed more deeply into the support aperture. Due to the conical form of the surfaces 30 and 32 and due to the gap 26 provided in the inner member 18, hereby the inner member is further radially pressed together so that the support thereof with respect to the outer member 16, the support thereof or clamping with respect to the tubular section 6 and the clamping of the object 4 are improved and intensified. The inner member 18 can be pressed in more deeply by a tool, for instance a hammer or the like, or else an additional split taper socket 48 according to FIG. 8 is used.

Figure 8:
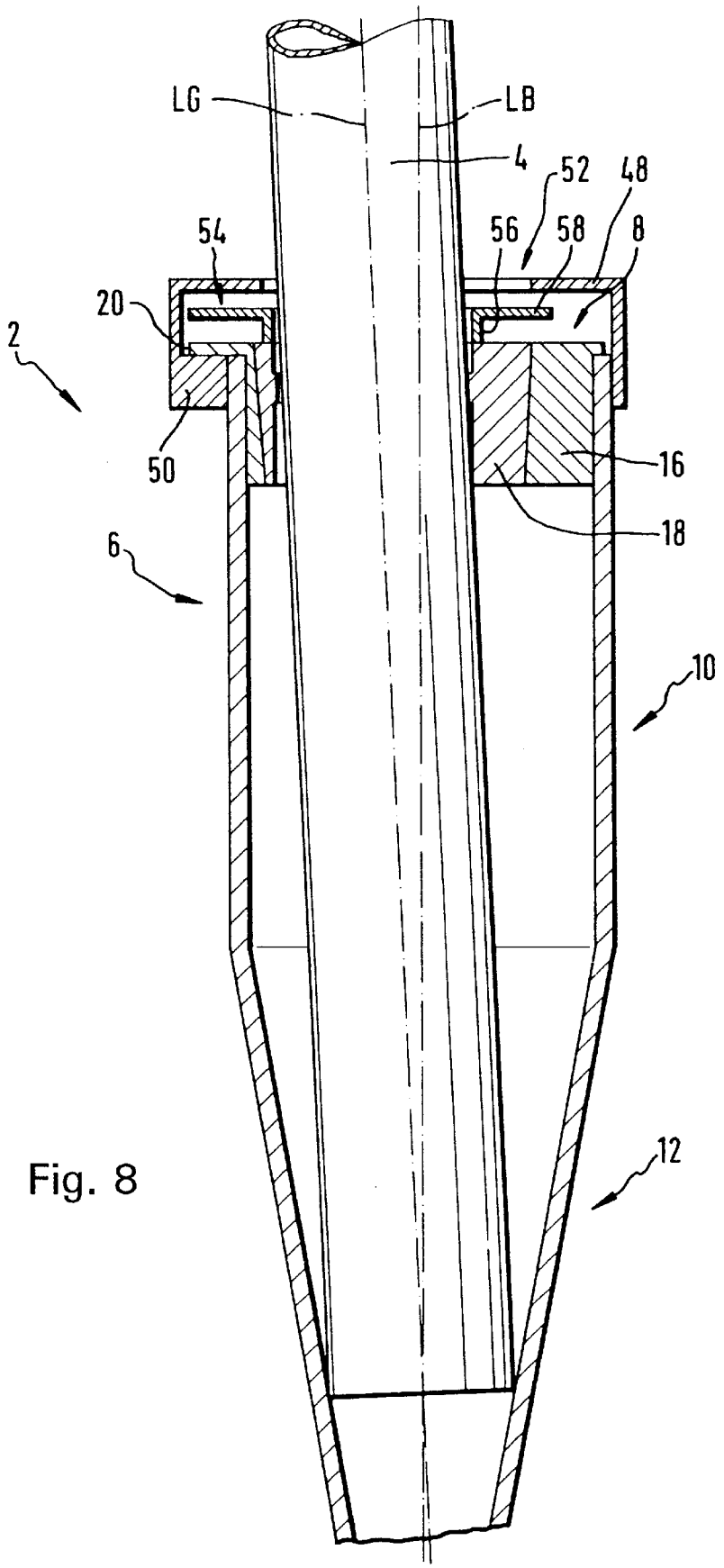
FIG. 8 is a view corresponding to FIG. 7 of a modified form of the present invention.

In FIG. 8, the same reference numerals as in FIG. 7 denote the same or corresponding parts so that the description is not repeated.

According to FIG. 8, the split taper socket 48 is set above the upper free edge of the tubular section 6. The shoulder 20 of the outer member 16 is designed in this modification or embodiment in accordance with the conical form of the support aperture 22 in the outer member 16, i.e. the center of the circularly circumferential shoulder 20 coincides with the center of the support aperture 22 in the outer member 16 so that in the drawing according to FIG. 8 the shoulder 20 projects further from the free edge of the tubular section 6 on the left side than on the right side. The socket 48 is integrally formed with an inwardly protruding section 50 which extends behind the shoulder of the outer member 16 from the bottom in the way evident from FIG. 8 and is adjacent to the outer circumferential wall of the tubular section 6. The section 50 has, just as the shoulder 20, no uniform thickness seen over its peripheral extension, but it has likewise a thickness which constantly increases or decreases and corresponds to the eccentricity of the support aperture 22 so that the section 50 in FIG. 8 is correspondingly thicker on the left side and correspondingly thinner on he right side, but nevertheless it is always supported by the lower side of the shoulder 20. The split taper socket 48 has a central opening 52 through which the object 4 is passed. Below the opening 52 another socket 54 consisting of a short vertical section 56 and a circumferential collar 58 perpendicular thereto is provided. The object 4 also passes through the opening in the socket 54 defined by the section 56 in the way evident from FIG. 8. The lower free vertical sections 56 are supported on the upper side of the inner member 18.

In order to be able to fix the object 4 after having maintained it in the upright position to the tubular section 6 by means of the inner member 18 and the outer member 16, it is proceeded as follows:

Before the object 4 is inserted into the tubular section 6, at first the split taper socket 48 and then the socket 54 are pushed from the lower free end of the object 4 onto the same. After that, the object 4 is appropriately aligned with the help of the inner member 18 and the outer member 16 with respect to the tubular section 6, which nay be effected, if necessary, with the aid of a suitable tool and the bores 38. Then the socket 54 is made to slide downward along the object 4 and to lie on the upper side of the inner member 18 and subsequently the split taper socket 98 is snapped behind and/or below the shoulder 20. By strongly stepping onto the upper side of the split taper socket 48 the same is moved downward and hereby forces the socket 54 via the collar 58 and thus the inner member 18 via the section 56 downward further into the outer member 16, the latter being radially compressed by the conical surfaces 30 and 32 as well as by the slit 26 and clamping, on the one hand, the object 4 and itself in the support aperture 22 of the outer member 16. Thus by providing the split taper socket 48 the inner member 18 can be pressed quickly and neatly into the outer member 16 so as to fix the previously set inclined position of the object with respect to the longitudinal axis LB of the anchoring device 2.

In another embodiment not represented in the drawing but equally preferred, the split taper socket 48 may also be a union nut which is in mesh with a male thread at the upper edge of the tubular section 6 and when screwed onto this male thread—with or without interposing an additional means coresponding to the socket 54—forces the inner member 18 correspondingly deeply into the outer member 16. Then the cuter member 16, the shoulder and the projection 50 are integrally formed and the union nut is in mesh with the male thread formed radially outwardly at the projection 50. This embodiment has the substantial advantage that due to the tightened union nut a permanent pressure is exerted on the inner member 18 so that the hold of the object 4 in the receiving aperture 24 is particularly resistent to vibrations and shocks.

If, for any reasons, the once adjusted exactly vertical alignment of the object 4 has changed in the course of time, it is sufficient to use a tool at the respective attachment points 38 and to change the relative positions of the inner member 18, the outer member 16 and the tubular section 6 with respect to each other until the eccentricity of the aperture 24 changing hereby with respect to the tubular section 6 brings the object 4 held herein into the vertical again. This can be effected quickly and easily without major manipulations being necessary.

Figure 5A:
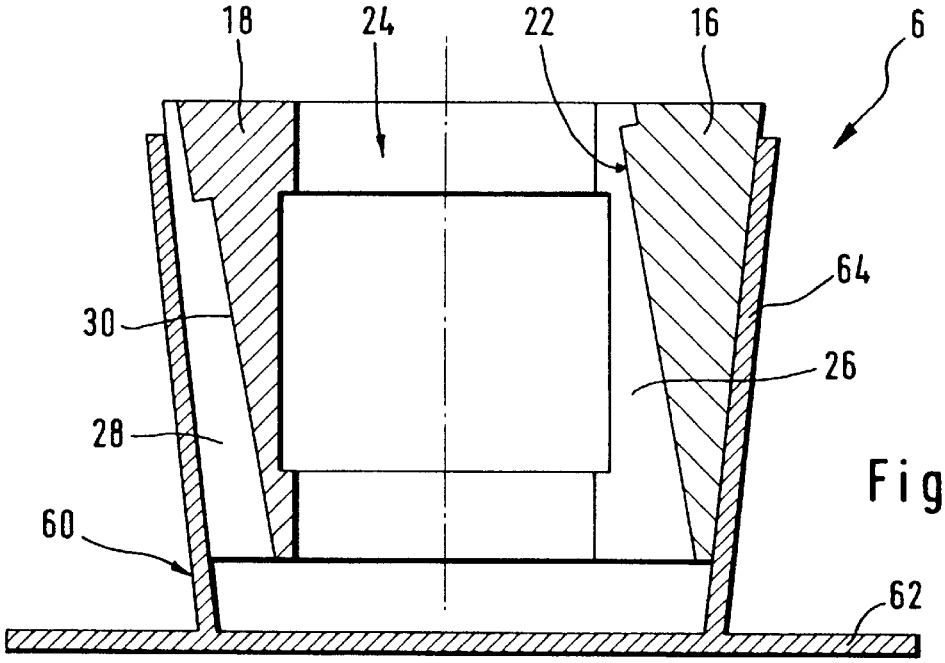
FIGS. 5A and 5B show an embodiment of the present invention in which the longitudinal axis of tile inner member can be tilted from the vertical by rotating the inner member relative to the outer member.
Figure 5B:
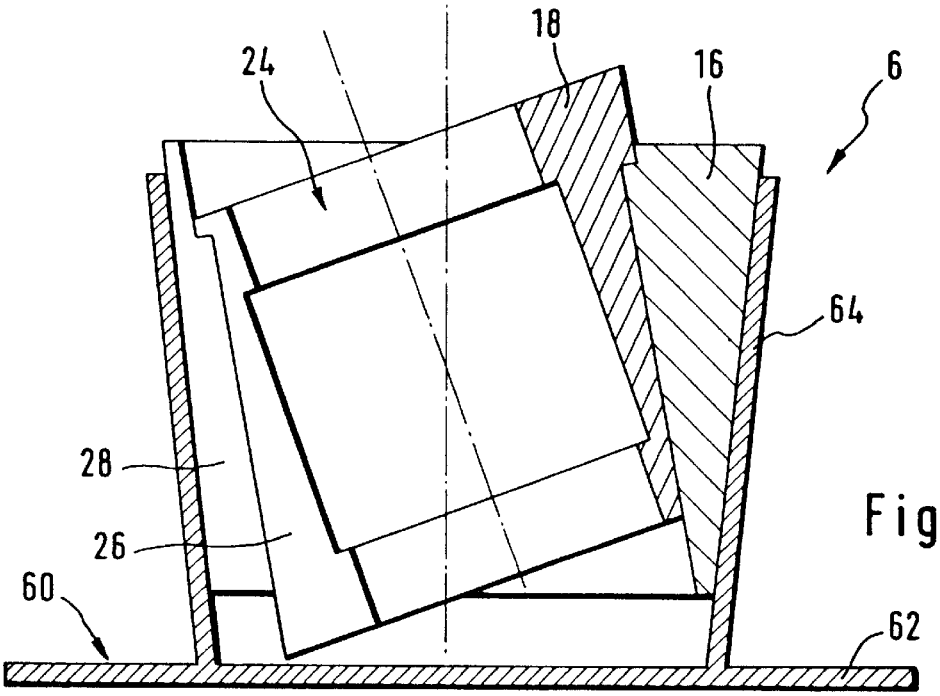

The FIGS. 5A and 5B show a modification of the present invention in which, compared to the embodiment according to the FIGS.1A to 4, larger tilting angles of the object 4 with respect to the tubular section 6 are possible. The FIGS. 5A and 5B moreover illustrate the possibility of providing the tubular section 6 not on a bottom dowel to be drilled into the ground or the like but on a cup-shaped ground support 60 including a circumferential wall 64 conically tapered toward a ground plate 62. The ground plate 62, for instance, can be fixedly screwed down with an underground or imbedded in concrete or otherwise fastened, or else it permits to freely place the tubular section 6 at any location. In the embodiment represented in the FIGS. 5A and 5B the support aperture 22 is introduced in the outer member 16 extending obliquely with respect to the vertical and the external face 30 of the inner member 18 has an oblique shape corresponding hereto in such a way that in the position according to FIG. 5A, where the two slits 26 and 28 of the inner member 18 and the outer member 16 are opposite to each other (analogously to the representation of FIG. 4), the longitudinal axis of the inner member 18 is in alignment with the longitudinal axis of tile tubular section, i.e. it is exactly vertical in the ideal case. When the inner member 18 is twisted with respect to the outer member 16, due to the oblique extension of the internal face 32 of the outer member 16 defining the support aperture 22, the inner member 18 is tilted with respect to the outer member 16 and thus with respect to the tubular section 6, as represented in FIG. 5B. FIG. 5B shows the maximum tilting state where the two slits 26 and 28 are in alignment (analogously to the representation according to FIG. 3), where the largest eccentricity or tilting of the inner member 18 with respect to the outer member 16 is given.

Compared to the embodiment according to FIGS. 1A to 4 and 7 or 8, resp., in this embodiment according to FIGS. 5A and 5B a by far greater tilting or inclination of the object 4 held in the receiving aperture 24 can be obtained.

It is understood that also combinations of the embodiments described so far are possible. So especially the eccentric arrangement of the support and receiving apertures according to FIGS. 1 to 4 can be combined with an inclination of these apertures in accordance with the FIGS. 5A and 5B. Also the arrangement of the conical faces 30 and 32 can be selected differently; for example the outer circumferential face of the outer member 16 and the inner circumferential face of the tubular section 6 can be conical.

Figure 6A:
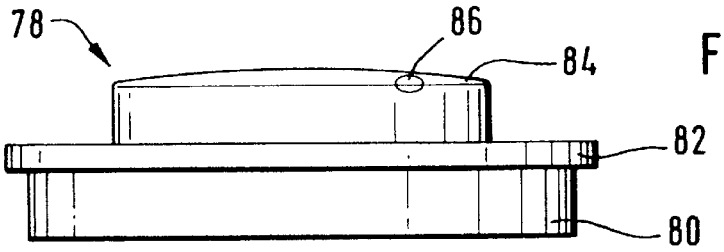
FIGS. 6A, 6B and 6C are views showing how the degree and the direction of eccentricity for maintaining the object in the exactly upright position by means of an auxiliary instrument, which is likewise the subject-matter of the present invention, can be determined and adjusted at the inner and outer members.
Figure 6B:
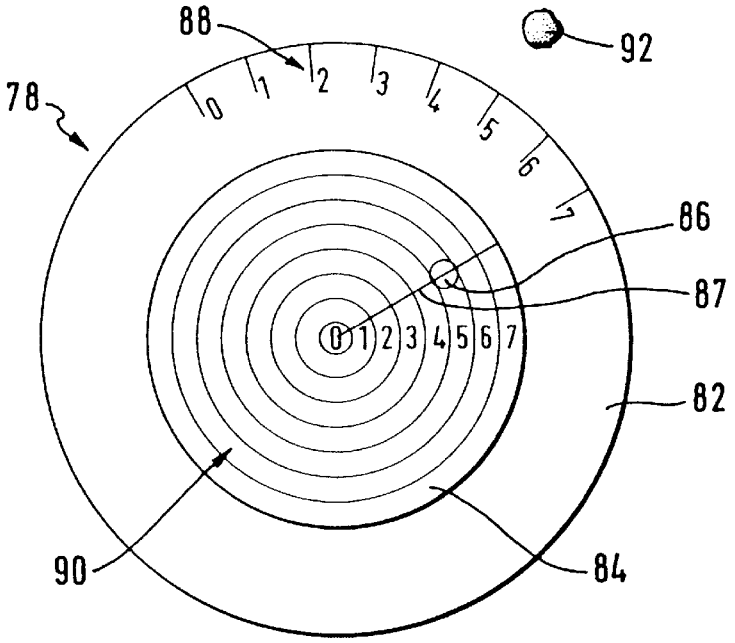
Figure 6C:
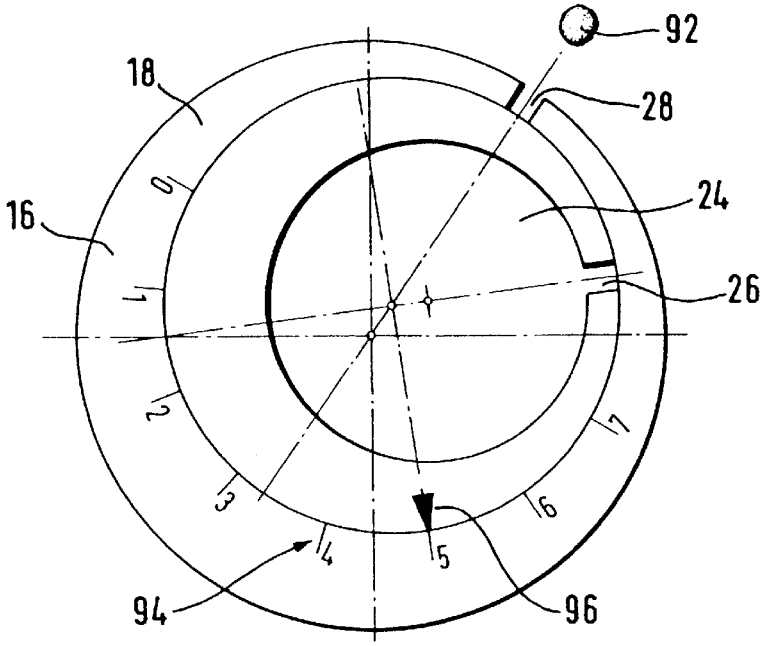

The FIGS. 6A to 6C show another embodiment of the present invention or an auxiliary instrument 78 by which the degree arid the direction of eccentricity for maintaining the object in the exactly vertical position call be determined and adjusted at the inner member 18 and the outer member 16.

According to FIG. 6A, the auxiliary instrument 78 includes a short vertical connecting piece 80 and a shoulder 62 above connected thereto. The outer diameter of the connecting piece 80 corresponds to the inner diameter of the upper free edge of the tubular section 6 so that the auxiliary instrument 78 can be supported at the upper free edge of the tubular section 6 in a way similar to the outer member 16. The shoulder 82 is part of a closed surface on which a bubble level 84 designed in a known way is arranged. In the level 84 an air bubble 86 floats in a known way. As one can best see from the top view of the auxiliary instrument 78 according to FIG. 6B, at the shoulder 82 a quarter circle sector is provided with a first scale 88 which may be divided from 0 to 7 in the represented embodiment. Furthermore the upper side of the sight class of the bubble level 84 is provided with a plurality of concentrical rings forming a second scale 90 which may likewise be extended from 0 to 7 from the center of the level 84 radially outwardly to the circumferential edge of the shoulder 82.

If in the top view according to FIG. 6B the air bubble 86 is exactly in the center of the concentrical circles forming the second scale 90, the whole arrangement is maintained in an exactly vertical position (principle of water level).

The FIGS. 6B and 6C now illustrate how an inclination, for instance, of the tubular section 6 detected by the bubble level 84 or the second scale 90 can be compensated by the device for maintaining the object in the upright position. For such a compensation it is necessary to knows both the direction of eccentricity and the degree of eccentricity. The compensation of the direction of inclination is effected by appropriately twisting the outer member 16 and the degree of compensation is effected by an appropriate twisting of the inner member 18.

It is assumed, according to FIG. 6B, that the tubular section 6 drilled into the ground is "inclined" in the top view according to FIG. 6B downward to the left so that the air bubble 86 of the level 84 may be shifted in the embodiment represented in FIG. 6B out of the center upward to the right and is located on the ring of the second scale 90 which is assigned to FIG. 5.

Now the level 84 is turned until the air bubble 86 is located—as shown in FIG. 6B—on a marking point 87 extending from zero or the center radially outwardly to the numeral 7 of the first scale 88. The numeral 5 read from the second scale 90 is now looked for on the first scale 88 and the position of this numeral 5 is marked by an object next to the tubular section 6, for instance by a stone 92. Then the auxiliary instrument 78 is taken off the upper free edge of the tubular section 6 and instead the outer member 16 is inserted so that the slit 28 of the outer member 16 points in the direction of the stone 92. On the semi-circular sector of the outer member 16 diametrally opposing the slit 28 a third scale 94 is provided which—analogously to the first and second scales—likewise ranges from 0 to 7. The inner member 18 is now inserted in the support aperture 22 of the outer member 16 such that a marking 96 on the upper side of the inner member 18 coincides with the numeral 5 of the third scale 94 at the outer member 16. Hereby the slit 26 of the inner member 18 is twisted with respect to the slit 28 of the outer member 16 by a predetermined angular amount so that also the aperture 24 of the inner member 18 adopts a certain eccentricity of direction and amount with respect to the center. This eccentricity is exactly the one, as to direction and amount, which compensates the original inclination of the tubular section 6 so that the object 4 is maintained in an exactly vertical position.

Thus it is possible, according to FIGS. 6A to 6C, either to first of all adjust the exactly vertical alignment of the object 4 with little effort while clamping the object 4 solely with the previous aid of the auxiliary instrument 78 or else to adjust the same afterwards by way of the previously established values using the tool which is employed at the bores 38 of the outer member 16 and the inner member 18.

I claim:

1. Anchoring apparatus for anchoring a bottom end portion of a pole having a pole longitudinal axis comprising:

a tubular section having an open top end and a tubular section longitudinal axis;

an annular outer member having an outer member center and being rotatably disposed on said tubular section at said open top end thereof;

said annular outer member including a support aperture that is eccentrically offset with respect to said outer member center;

an annular inner member having an inner member center and a pole receiving aperture that is eccentrically offset with respect to said inner member center;

said annular inner member being rotatably disposed within said support aperture of said annular outer member;

said annular inner and outer members being rotatable to vary the positions of said support aperture and said receiving aperture to selectively tilt the bottom end portion of a pole that extends into said tubular section through said receiving aperture for bringing the pole longitudinal axis to a desired position with respect to the direction of said tubular section longitudinal axis;

said annular outer member having a reduced wall thickness portion outwardly of said support aperture in the direction in which said support aperture is eccentrically offset with respect to said outer member center;

said annular inner member having a reduced wall thickness portion outwardly of said receiving aperture in the direction in which said receiving aperture is eccentrically offset with respect to said inner member center; and each of said annular inner and outer members having an axially and radially continuous slit in said reduced wall thickness portions.

2. The anchoring apparatus of claim 1 wherein said support aperture in said annular outer member and said annular inner member have cooperating conically tapered surfaces that provide outward expansion of said annular outer member and inward contraction of said annular inner member when said annular inner member is forced axially into said support aperture.

3. The anchoring apparatus of claim 2 including a locking device that moves said annular inner member into said support aperture to expand said annular outer member outwardly into engagement with said tubular section while contracting said inner annular member inwardly into engagement with a pole that extends through said receiving aperture to lock said annular inner and outer members against rotation.

4. Anchoring apparatus for anchoring a bottom end portion of a pole having a pole longitudinal axis comprising:

a tubular section having an open top end and a tubular section longitudinal axis;

an annular outer member having an outer member center and being rotatably disposed on said tubular section at said open top end thereof;

said annular outer member including a support aperture that is eccentrically offset with respect to said outer member center;

an annular inner member having an inner member center and a pole receiving aperture that is eccentrically offset with respect to said inner member center;

said annular inner member being rotatably disposed within said support aperture of said annular outer member;

said annular inner and outer members being rotatable to vary the positions of said support aperture and said receiving aperture to selectively tilt the bottom end portion of a pole that extends into said tubular section through said receiving aperture for bringing the pole longitudinal axis to a desired position with respect to the direction of said tubular section longitudinal axis;

said annular inner member having an outer peripheral wall that extends obliquely with respect to said tubular section longitudinal axis;

said support aperture in said annular outer member having a support aperture peripheral wall that extends obliquely to said tubular section longitudinal axis; and said receiving aperture in said annular inner member having a receiving aperture peripheral wall that extends obliquely with respect to said tubular section longitudinal axis.

5. Anchoring apparatus for anchoring a bottom end portion of a pole having a pole longitudinal axis comprising:

a tubular section having an open top end and a tubular section longitudinal axis;

an annular outer member having an outer member center and being rotatably disposed on said tubular section at said open top end thereof;

said annular outer member including a support aperture that is eccentrically offset with respect to said outer member center;

an annular inner member having an inner member center and a pole receiving aperture that is eccentrically offset with respect to said inner member center;

said annular inner member being rotatably disposed within said support aperture of said annular outer member;

said annular inner and outer members being rotatable to vary the positions of said support aperture and said receiving aperture to selectively tilt the bottom end portion of a pole that extends into said tubular section through said receiving aperture for bringing the pole longitudinal axis to a desired position with respect to the direction of said tubular section longitudinal axis;

said receiving aperture in said inner annular member having an inner circumferential wall; and a circumferential rail-like projection extending inwardly from said inner circumferential wall.

6. Anchoring apparatus for anchoring a bottom end portion of a pole having a pole longitudinal axis comprising:

a tubular section having an open top end and a tubular section longitudinal axis;

an annular outer member having an outer member center and being rotatably disposed on said tubular section at said open top end thereof;

said annular outer member including a support aperture that is eccentrically offset with respect to said outer member center;

an annular inner member having an inner member center and a pole receiving aperture that is eccentrically offset with respect to said inner member center;

said annular inner member being rotatably disposed within said support aperture of said annular outer member;

said annular inner and outer members being rotatable to vary the positions of said support aperture and said receiving aperture to selectively tilt the bottom end portion of a pole that extends into said tubular section through said receiving aperture for bringing the pole longitudinal axis to a desired position with respect to the direction of said tubular section longitudinal axis;

said annular inner member having an inner member longitudinal axis coincidental with said inner member center;

said annular outer member having an outer member longitudinal axis coincidental with said outer member center; and said inner member longitudinal axis being tiltable with respect to said outer member longitudinal axis by rotation of said annular inner member relative to said annular outer member.

7. Anchoring apparatus for anchoring a bottom end portion of a pole having a pole longitudinal axis comprising:

a tubular section having an open top end and a tubular section longitudinal axis;

an annular outer member having an outer member center and being rotatably disposed on said tubular section at said open top end thereof;

said annular outer member including a support aperture that is eccentrically offset with respect to said outer member center;

an annular inner member having an inner member center and a pole receiving aperture that is eccentrically offset with respect to said inner member center;

said annular inner member being rotatably disposed within said support aperture of said annular outer member;

said annular inner and outer members being rotatable to vary the positions of said support aperture and said receiving aperture to selectively tilt the bottom end portion of a pole that extends into said tubular section through said receiving aperture for bringing the pole longitudinal axis to a desired position with respect to the direction of said tubular section longitudinal axis; and said annular outer member being at least partly received within said tubular section through said open top end thereof and having an outwardly extending flange engaging said top end to rotatably support said annular outer member on said tubular section.

8. Anchoring apparatus for anchoring a bottom end portion of a pole having a pole longitudinal axis comprising:

a tubular section having an open top end and a tubular section longitudinal axis;

said tubular section having a cylindrical upper position and a conically tapered lower portion that tapers to a smaller size in a direction away from said open top end;

an annular outer member having an outer member center and being rotatably disposed on said tubular section at said open top end thereof;

said annular outer member including a support aperture that is eccentrically offset with respect to said outer member center;

an annular inner member having an inner member center and a pole receiving aperture that is eccentrically offset with respect to said inner member center, said receiving aperture having a receiving aperture longitudinal axis;

said annular inner member being rotatably disposed within said support aperture of said annular outer member;

a pole being supportable within said tubular section by positioning a pole through said receiving aperture with the pole bottom end engaging said conically tapered lower portion of said tubular section, said receiving aperture being shaped and dimensioned to provide for inclination of the pole with respect to said receiving aperture for bringing the pole longitudinal axis to a desired position with respect to said receiving aperture longitudinal axis; and said annular inner and outer members being rotatable to vary the positions of said support aperture and said receiving aperture to selectively tilt the pole for bringing the pole longitudinal axis to a desired position with respect to the direction of said tubular section longitudinal axis.

9. Apparatus for anchoring a bottom end portion of a pole having a pole longitudinal axis comprising:

a cup member having an open top, a cup longitudinal axis and a conically tapered interior surface that tapers to a smaller size in a direction away from said open top;

a radially split annular outer member rotatably received in said cup and having a conically tapered outer surface engaging said conically tapered interior surface of said cup;

said annular outer member having a support aperture therethrough with a support aperture longitudinal axis that is inclined with respect to said cup longitudinal axis;

an annular inner member rotatably received in said support aperture;

said annular inner member having a pole receiving aperture therethrough with a receiving aperture longitudinal axis;

said annular inner and outer members having cooperating cam surfaces thereon for selectively tilting said receiving aperture longitudinal axis relative to said cup longitudinal axis by rotation of said annular inner member relative to said annular outer member.

* * * * *